US006534232B1

(12) United States Patent
Matsuda et al.

(10) Patent No.: US 6,534,232 B1
(45) Date of Patent: Mar. 18, 2003

(54) ELECTROPHOTOGRAPHIC IMAGE FORMATION METHOD, CARRIER FOR TWO-COMPONENT DEVELOPER, TWO-COMPONENT DEVELOPER, CONTAINER HOLDING THEREIN THE TWO-COMPONENT DEVELOPER, AND ELECTROPHOTOGRAPHIC IMAGE FORMATION APPARATUS

(75) Inventors: Hiroaki Matsuda, Shizuoka (JP); Masanori Suzuki, Shizuoka (JP); Akemi Sugiyama, Shizuoka (JP); Hiroto Higuchi, Shizuoka (JP); Tsunemi Sugiyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/567,982

(22) Filed: May 10, 2000

(30) Foreign Application Priority Data

May 10, 1999 (JP) ..... 11-128879

(51) Int. Cl.[7] ..... G03G 9/113

(52) U.S. Cl. ..... 430/111.32; 430/111.35; 430/111.1; 222/192; 222/DIG. 1

(58) Field of Search ..... 430/108, 106.6, 430/111.35, 111.32, 111.1; 222/DIG. 1, 192

(56) References Cited

U.S. PATENT DOCUMENTS 4,482,621 A * 11/1984 Kashiwagi ..... 430/108
5,565,291 A * 10/1996 Mayama et al. ..... 430/106.6
5,766,814 A * 6/1998 Baba et al. ..... 430/108

OTHER PUBLICATIONS

Diamond, Arthur S. (editor) Handbook of Imaging Materials. New York: Marcell–Deker, Inc. pp. 202–205. (1991).*

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic image formation method for developing a latent electrostatic image formed on a latent image bearing member with toner to a toner image, using a two-component developer including a carrier and a toner. The zoner is held on a developer bearing member, with a gap between the facing surfaces of the latent image bearing member and the developer bearing member being set in a range of 0.1 mm to 0.5 mm. The carrier includes carrier particles, each carrier particle including a core material and a coating material which is coated on the surface of the core material The coating material includes a polysiloxane resin including at least an oxygen atom (O) and a silicon atom as constituent elements therefor, with an atomic ratio of the constituent elements, O/Si, being in a range of 2.1 to 4.0, and the carrier having a specific resistivity of $10^9$ to $10^{16}$ Ω·cm. A container holding therein the two-component developer, and an electrophotographic image formation apparatus with this container incorporated therein are disclosed.

6 Claims, 2 Drawing Sheets

ELECTROPHOTOGRAPHIC IMAGE FORMATION METHOD, CARRIER FOR TWO-COMPONENT DEVELOPER, TWO-COMPONENT DEVELOPER, CONTAINER HOLDING THEREIN THE TWO-COMPONENT DEVELOPER, AND ELECTROPHOTOGRAPHIC IMAGE FORMATION APPARATUS

BACKGROUND OF THE INVENTION

1. Field of the Invention

The present invention relates to an electrophotographic image formation method using a two-component developer, a carrier for the two-component developer, the two-component developer for use in electrophotography, a container holding therein the two-component developer, and an electrophotographic image formation apparatus.

2. Discussion of Background

Conventionally, many electrophotographic image formation methods are known. Generally, in those electrophotographic image formation methods, a latent electrostatic image is formed on a photoconductor containing therein a photoconductive material, utilizing the characteristics of the photoconductive material, by use of various means. The latent electrostatic image is then developed with a developer to a visible toner image, and when necessary, the visible toner image is transferred to a transfer sheet such as a sheet of paper and fixed thereto with the application of heat and/or pressure or the like thereto, whereby a copy is obtained.

Recently, in addition to the conventional copying machines, there have been used a large number of apparatus, using eiectrophotography, such as printers and facsimile apparatus. In the field of copying machines and printers, there is always customer's demand for high speed and stabilized operation. Currently in such high speed copying machines and printers, a two-component development method, using a two-component developer comprising a carrier and a toner is mainly used.

In the current course of development of such high speed copying machines and printers, one of the largest subjects to be targeted is to secure stabilized development performance with high efficiency.

As one of the trials for the achievement of the above subject, it has been proposed to minimize a gap between a latent image bearing member and a developer bearing member, thereby intensifying an electric field for development, and improving the development performance of toner.

However, an analysis of the above-mentioned trial, conducted by the inventors of the present invention, indicated that as the gap is narrowed, a developer tends to build up between a development area and a member called "doctor blade" for controlling the amount of the developer on the developer bearing member, so that the movement of the developer tends to slow. When a development bias charge is applied to the developer in such a state, electric charges are selectively injected into the carrier when the carrier has a low resistivity. The result is that instead of the toner, the carrier is deposited on an image area on the latent image bearing member, so that the latent electrostatic image in the image area is developed, not with the toner, but with the carrier. When such deposition of the carrier takes place on the latent image bearing member, the deposited carrier works as a spacer between the image transfer material and the latent image bearing member. As a result, non-image-transferred portions are formed in the transferred image area on the image transfer material.

There have not yet been devised any countermeasures against such deposition of the carrier on the latent electrostatic image bearing member, which takes place when the gap between the latent electrostatic image bearing member and the developer bearing member is narrowed.

However, there has been a conventional proposal of increasing the electric resistivity of the carrier itself to about $10^{13}$ Ω·cm or more, without being aware of narrowing the gap between the latent electrostatic image bearing member and the developer bearing member. For example, in Japanese Laid-Open Patent Application No. 7-234548, it is proposed that the surface of a core material be coated almost in its entirety with a resin with high resistivity, whereby a carrier with high resistivity can be obtained. In fact, this method produces the effect of reducing the deposition of the carrier. However, this method has the problem that the development performance is reduced so that images with sufficiently high density for practical use cannot be obtained.

SUMMARY OF THE INVENTION

It is therefore a first object of the present invention to provide an electrophotographic image formation method by which the above-mentioned conventional problems are solve and which is capable of forming images with high quality, with high development performance, free of the carrier's deposition and abnormalities in image quality such as the formation of non-image-transferred portions.

The second object of the present invention is to provide a carrier for a two-component developer for use in the above-mentioned electrophotographic image formation method.

The third object of the present invention is to provide a two-component developer for use in the above-electrophotographic image formation method.

The fourth object of the present invention is to provide a container in which the above-mentioned two-component developer is held.

The fifth object of the present invention is to provide an electrophotographic image formation apparatus for use in the above-mentioned electrophotographic image formation method.

The first object of the present invention can be achieved by an electrophotographic image formation method for developing a latent electrostatic image formed on a latent image bearing member with toner to a toner image, using a two-component developer comprising a carrier and a toner, the toner being held on a developer bearing member, with a gap between the mutually facing surfaces of the latent image bearing member and the developer bearing member being set in a range of 0.1 mm to 0.5 mm, and the carrier comprising carrier particles, each carrier particle comprising a core material and a coating material which is coated on the surface of the core material, the coating material comprising a polysiloxane resin comprising at least an oxygen atom (O) and a silicon atom as constituent elements therefor, with an atomic ratio of the constituent elements, O/Si, being in a range of 2.1 to 4.0, and the carrier having a specific resistivity of $10^9$ to $10^{16}$ Ω·cm.

The polysiloxane resin used in the carrier for the two-component developer for use in the above electrophotographic image formation method may further comprise a nitrogen atom (N), with an atomic ratio of the nitrogen atom to the silicon. atom, N/Si, being in a range of 0.1 to 4.0.

It is preferable that the carrier have a fluidity of 20 sec/50 g to 40 sec/50 g.

The second object of the present invention can be achieved by a carrier comprising carrier particles, each carrier particle comprising a core material and a coating material comprising a polysiloxane resin, which is coated on the surface of the core material, the polysiloxane resin comprising at least an oxygen atom (O) and a silicon atom as constituent elements therefor, with an atomic ratio of the constituent elements, O/Si, being in a range of 2.1 to 4.0, the carrier having a specific resistivity of $10^9$ to $10^{16}$ Ω·cm.

The polysiloxane resin used in the carrier may further comprise a nitrogen atom (N), with an atomic ratio of the nitrogen atom to the silicon atom, N/Si, being in a range of 0.1 to 4.0.

It is preferable that the carrier have a fluidity of 20 sec/50 g to 40 sec/50 g.

The third object of the present invention can be achieved by a two-component developer which comprises a toner and the above-mentioned carrier.

The fourth object of the present invention can be achieved by a container holding therein the above-mentioned two-component developer.

The fifth object of the present invention can be achieved by an electrophotographic image formation apparatus comprising the above-mentioned container.

The fifth object of the present invention can also be achieved by an electrophotographic image formation apparatus comprising a latent electrostatic image bearing member and a developer bearing member, which are disposed with a gap of 0.1 to 0.5 mm between the facing surfaces of the latent electrostatic image bearing member and the developer bearing member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
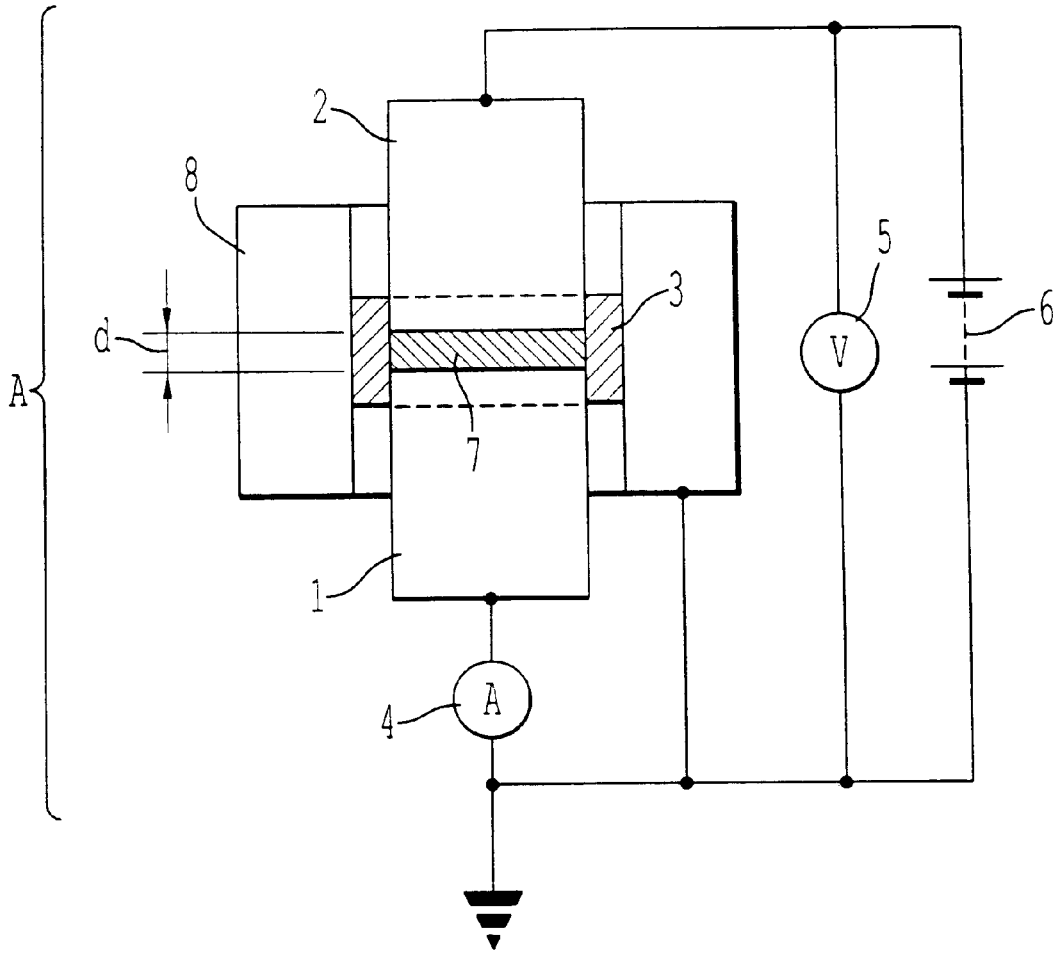
FIG. 1 is a diagram of an instrument for measuring the specific resistivity of a sample carrier.

As mentioned above, the first object of the present invention can be achieved by an electrophotographic image formation method for developing a latent electrostatic image formed on a latent image bearing member with toner to a toner image, using a two-component developer comprising a carrier and a toner, the toner being held on a developer bearing member, with a gap between the mutually facing surfaces of the latent image bearing member and the developer bearing member being set in a range of 0.1 mn to 0.5 mm, and the carrier comprising carrier particles, each carrier particle comprising a core material and a coating material which is coated on the surface of the core material, the coating material comprising a polysiloxane resin comprising at least an oxygen atom (O) and a silicon atom as constituent elements therefor, with an atomic ratio of the constituent elements, O/Si, being in a range of 2.1 to 4.0, and the carrier having a specific resistivity of $10^9$ to $10^{16}$ Ω·cm.

In the present invention, the gap between the mutually facing surfaces of the latent image bearing member and the developer bearing member (hereinafter the gap is simply referred to the gap between the latent image bearing member and the developer bearing member) is specifically set as mentioned above, and the necessary conditions for the carrier for the two-component developer are also specified as mentioned above, and by the combination of the specific gap and the conditions for the carrier, high development performance can be attained with the toner and images with high quality can be obtained.

As mentioned above, the gap between the latent image bearing member and the developer bearing member is set in the range of 0.1 mm to 0.5 mm. It is preferable that the gap be in the range of 0.2 mm to 0.4 mm.

When the gap between the latent image bearing member and the developer bearing member is 0.5 mm or less, an appropriate electric field for development can be obtained by the application of a development bias to the developer, and when the gap is 0.1 mm or more, the gap can be controlled accurately in the axial direction of the photoconductor, so that uniform images can be easily obtained because the deviation of image density in the axial direction of the photoconductor can be appropriately controlled.

However, by merely narrowing the gap between the latent image bearing member and the developer bearing member to the range of 0.1 mm to 0.5 mm, the formation of non-image-transferred portions caused by the deposition of the carrier cannot be sufficiently prevented.

In the present invention, not only by narrowing the gap between the latent image bearing member and the developer bearing member to the range of 0.1 mm to 0.5 m. but also by setting the specific resistivity of the carrier in the range of $10^9$ to $10^{16}$ Ω·cm, the formation of non-image-transferred portions caused by the deposition of the carrier can be sufficiently and effectively prevented.

When the specific resistivity of the carrier is $10^{16}$ Ω·cm or less, the intensity of the electric field for development is not reduced in the development area, so that images with sufficiently high image density can be obtained, and when the specific resistivity of the carrier is $10^9$ Ω·cm or more, the charge injection into the carrier does not take place. It is particularly preferable that the specific resistivity of the carrier be in the range of $10^{10}$ Ω·cm to $10^{14}$ Ω·cm.

With reference to FIG. 1, how to measure the specific resistivity of the carrier of the present invention will now be explained.

A sample carrier 7 is packed into a cell A. A lower electrode 1 and an upper electrode 2 are connected to the cell A as shown in FIG. 1. In FIG. 1, reference numeral 3 indicates an insulator. A voltage is applied across the electrodes 1 and 2, so that the current that flows through the sample carrier 7 at this moment is measured, whereby the specific resistivity of the sample carrier 7 is determined. In FIG. 1, reference numeral 4 indicates an ammeter; reference numeral 5, a potentiometer; reference numeral 6, a power source; and reference numeral 8, a holder.

In this method, the carrier is a powder so that the packing thereof may change, and the specific resistivity of the carrier to be determined may also change depending upon the packing of the carrier. Therefore, the measurement must be carried out with the utmost care so as not to cause any changes in the packing.

More specifically, the specific resistivity of the carrier of the present invention was measured under the conditions that the contact area (S) between the packed carrier and each of the electrodes 1 and 2 was about 4.0 $cm^2$ (S=4.0 $cm^2$), the thickness (d) of the packed carrier was about 2 mm (d=about 2 mm), the load applied to the upper electrode 2 was 275 g, and the applied voltage was 500 V.

In the present invention, it was confirmed that in order to set the specific resistivity Of the carrier of the present invention in the appropriate range, that is, in the range of $10^9$ Ω·cm to $10^{16}$ Ω·cm, thereby preventing the formation of the non-image-transferred portions, it was necessary that the surface of each carrier particle be coated with a coating material comprising a polysiloxane resin which comprises at least an oxygen atom (O) and a silicon atom (Si) as constituent elements therefor, with an atomic ratio of the constituent elements, O/Si, being in a range of 2.1 to 4.0.

The use of the resin is also effective for improving the fluidity of the carrier and activating the stirring motion of the developer in the development area, whereby the developer which is capable of developing the latent electrostatic images can be constantly transported to an image area of the latent electrostatic image bearing member This facilitates obtaining images with sufficiently high image density for practical use. Furthermore, the activated motion of the developer makes it difficult to cause the selective injection of charges into the carrier, whereby the non-charge-injection range of the carrier is widened.

Furthermore, the inventors of the present invention recognized that the fluidity of the carrier was an important factor for activating the motion of the developer in the reservoir of the developer and confirmed that it was preferable that the carrier had a fluidity of 20 sec/50 g to 40 sec/50 g for the achievement of the objects of the present invention.

The following mechanism is considered to work in that the activation of the motion or the developer in the reservoir thereof is effective for hindering the deposition of the carrier:

In many cases, a developer which is made inactive in the stirring motion in the reservoir thereof is outside the magnetic flux of the developer bearing member, so that the developer is apt to move onto the surface of the latent electrostatic image bearing member. Furthermore, it is considered that the developer which is made inactive in the stirring motion in the reservoir thereof is also apt to be selectively subjected to the charge injection by the application of the development bias thereto.

When the fluidity of the carrier is as good as 40 sec/50 g or less, the carrier can smoothly impart triboelectric charges to the toner supplied, so that the conditions that the gap between the latent image bearing member and the developer bearing member is 0.5 mm or less further more effectively work. Since the fluidity of the carrier is 20 sec/50 g or more, the slippage of the carrier can be so advantageously controlled that the developer can be appropriately transported by utilizing the frictional resistance of the developer.

The fluidity of the carrier is determined by measuring the time required for 50 g of the carrier to fall down in accordance with the Japanese Industrial Standards JIS Z 2502. Prior to the measurement of the fluidity, the sample carrier is allowed to stand at a temperature of 23° C.±3° C. and a humidity of 60%±10% for 2 hours, and then used for the measurement.

Figure 2:
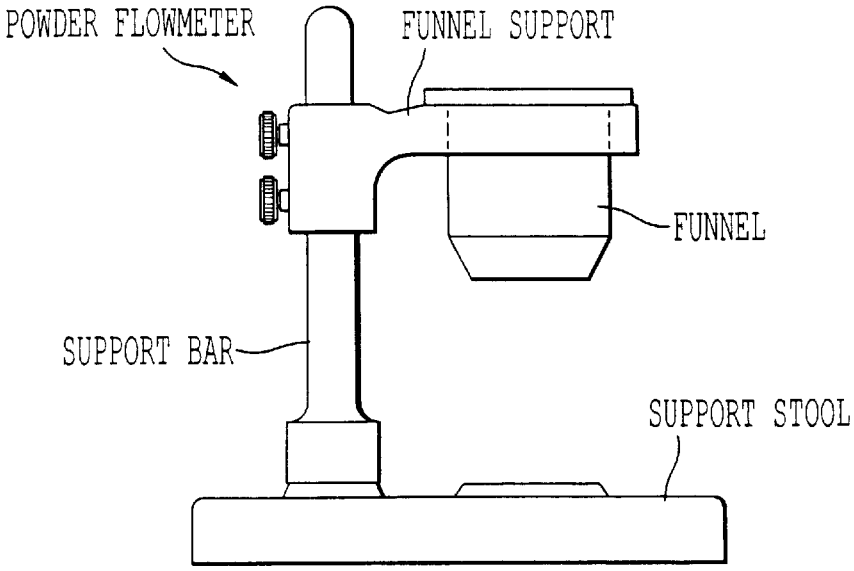
FIG. 2 is a diagram of the powder flowmeter used in accordance with JIS Z 2502.
Figure 3A:
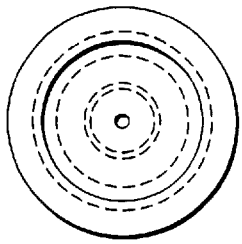
FIG. 3 is a funnel in the powder flowmeter used in accordance with JIS Z 2502.
Figure 3B:
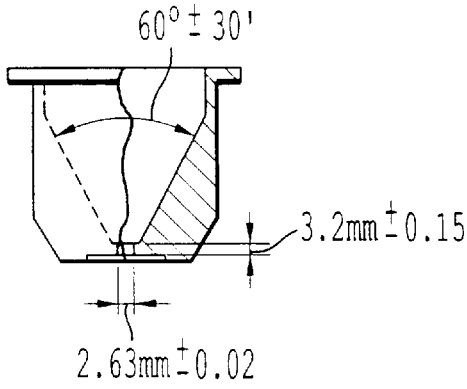

The Japanese Industrial Standard, JIS Z 2502 is described in detail below in paragraphs 1–4 and the accompanying FIGS. 2 and 3.

1. Scope

This Japanese Industrial Standard specifies a test method for determination of flow rate of metal powders, and shall be applied for those powders, hereinafter referred to as the "specimen", which will flow out spontaneously through the specified apparatus.

2. Apparatus 2.1. Powder Flowmeter: A powder flowmeter to be used is as shown in FIG. 2 consisted of a funnel, funnel support, support bar and support stool. The funnel to be used is as shown in FIG. 3. The funnel support shall be capable to rotate in horizon around the support bar and shall be adjusble in vertical by means of a clash.

2.2. Stopwatch: A stopwatch accurate to ±0.2 sec. shall be used.

2.3. Balance: A balance with a sensitivity of 50 mg and capable to weigh 50 g and over shall be used.

2.4. Dryer: A device capable to maintain the temperature within the furnace at 105±5° C. shall be used.

3. Measurement 3.1. At least 200 g of specimen is necessary.

3.2. Put the specimen into the dryer, hold at 105±5° C. for 1 h, and then cool it in a desiccator to room temperature. The specimen shall be taken out from the desiccator immediately before the subsequent testing. Especially, only when it is needed to make measurement as accepted condition, the drying procedure may be omitted.

3.3. Divide the specimen into three parts, take 50±0.1 g of specimen for measurement from respective specimen part and weigh, close the orifice at the bottom of funnel, and then transfer the specimen to the funnel. In this case, the powder shall be filled sufficiently in the part of orifice.

3.4. In measuring, operate the stopwatch simultaneously with the opening of the orifice and stop at the instant the last of powder leaves the orifice. The elapsed time shall be read to 0.2 sec. unit.

3.5. One measurement shall be made on each part of specimen having divided into three parts to be measured.

4. Record

The arithmetic mean of three measured values obtained according to 3.5 shall be corrected by multiplying the correction factor([1]), and the result obtained shall be rounded off to the unit digit in accordance with JIS Z 8401, in sec./50 g to determine the flow rate.

When the drying procedure of specimen is omitted, this matter shall be additionally noted.

(1) Correction Factor: The correction factor shall be determined in accordance with the following method by the manufacturer of powder flowmeter:

Using identically the method and means described before, make 5 measurements on flow rate of standard sample of A #100 Alundam, and obtain the arithmetic mean thereof (The average value shall be stamped on the bottom of funnel. The atomospheric humidity at measuring time shall be 60% or less, and the dispersion of the measured values of 5 determination shall not exceed 0.6 sec.). The correction factor of the funnel shall be 40.0 divided by this average value.

It is recommended that the factor is periodically verified by the user, too, by determining the flow rate of the standard sample according to the above method. If the flow rate deviates from that stamped value on the funnel, the new correction factor shall be 40.0 divided by this new flow rate.

In adopting the new correction factor, it is important to investigate the cause of deviation on flow rate. Since an increase of flow rate is mostly due to the wearing of orifice by repeated use, a new correction factor may be applicable.

A decrease in flow rate may indicate an adhesion of soft powder upon the orifice, the powder should be removed and followed by retesting for calibration.

When the increase of flow rate for the standard sample is 37.0 sec. or more, the relevant funnel shall not be used.

As mentioned above, each carrier particle of the carrier of the present invention comprises a core material and the coating material comprising the polysiloxane resin which comprises at least an oxygen atom (O) and a silicone atom (Si) as constituent elements therefor and serves as a coating material, with an atomic ratio of the constituent elements, O/Si, being in the range of 2.1 to 4.0. The resin can be formed from a silane compound. A coating layer comprising the polysiloxane resin has a glass-like structure, so that the coating layer is extremely hard and serves to form the carrier with high fluidity.

As an effective silane compound for forming the polysiloxane resin for use in the present invention, a 3-functional silane compound and a 4-functional silane compound can be preferably employed.

Specific examples of 3-functional silane compounds are amino-group-containing compounds such as N-β (aminoethyl) γ-aminopropyltrimethoxysilane, N-β (aminoethyl) γ-aminopropyltriethoxysilane, N-β (aminoethyl) γ-aminopropyltriisopropoxysilane, N-β (aminoethyl) γ-aminopropylrributoxysilane, β-aminopropyltrimethoxysilane, γ-aminopropyltriethoxysilane, γ-aminopropyltriisopropoxysilane, γ-aminopropyltributoxysilane, γ-aminopropyltriacetoxysilane, γ-(2-ureidoethyl) aminopropyltrimetoxysilane, γ-(2-ureidoethyl)-aminoprbpyltrimethoxysilane, γ-ureidopropyltriethoxysilane, and N-β-(N-vinylbenzylaminoethyl)-γ-amino-propyltrimethoxysilane; epoxy-group-containing compounds such as β-(3,4-epoxycyclohexyl)ethyltriethoxysilane, β-(3,4-epoxycyclohexyl)ethyltriisopropoxysilane, γ-glycidoxypropyltrimethoxysilane, γ-glycidoxypropyltriethoxysilane, and γ-glycidexypropyltriisopropoxysilane; isocyanate-group-containing compounds such as γ-isacyanopropyltrimethoxysilane, and γ-isocyanopropyltriethoxysilane; and mercapto-group-containing compounds such as γ-mercaptopropyltrimethoxysilane, and γ-mercaptopropyltriethoxysilane.

One or two or more kinds of the above-mentioned 3-functional silane compounds can be employed. In order to obtain positive chargeability which is preferable for the carrier, the above-mentioned amino-group-containing silane compounds are preferable.

Specific examples of 4-functional silane compounds are tetramethoxysilane, tetraethoxysilane, tetraisopropoxysilane, and tetrabutoxysilane One or two or more of the above-mentioned 4-functional silane compounds can be employed. Furthermore, hydrolyzed condensed compounds thereof can also be employed. Of such hydrolyzed condensed compounds, methyl silicate and ethyl silicate are preferable in view of the easiness in formation of a film.

These silane compounds can be used as the coating material for the carrier, either as they are, or in the form of alkyl silicate with further hydrolysis of the silane compounds.

Of the above-mentioned polysiloxane resins comprising at least an oxygen atom and a silicon atom as constituent elements for use in the present invention, polysiloxane resins which further comprise a nitrogen atom, with an atomic ratio of the nitrogen atom to the silicon atom, that is, a N/Si atomic ratio, being in the range of 0.1 to 4.0 (N/Si=0.1 to 4.0), are preferable since such polysiloxane resin are capable of imparting an appropriate positive chargeability to the carrier. It is more preferable that the N/Si atomic ratio be in the range of 0.4 to 3.0 (N/Si=0.4 to 3.0) The carrier comprising such a polysiloxane resin as the coating material is capable of further improving the development performance of the toner by causing the toner to have a sharper charge quantity distribution.

When the N/Si atomic ratio is 0.1 or more, there can be imparted to the carrier a sufficient positive chargeability for controlling the occurrence of toner deposition on the background of an image area. When the N/Si atomic ratio is 4.0 so less, the carrier can retain the positive chargeability with appropriate intensity, so that an appropriate positive chargeability can be imparted to the toner, and an appropriate charge quantity distribution can be obtained.

When necessary, to the coating material for the carrier of the present invention, there can be added various inorganic and organic additives, such as a curing catalyst, a wettability improving agent, a plasticizer, a defoaming agent, and a thickening agent, as long as the effects of the present invention are not impaired by the addition thereof.

As mentioned above, each carrier particle of the carrier of the present invention comprises the core material and the coating material with which the surface of the core material is coated.

There is no particular restriction on the kind of material for the core material. As the material for the core material, there can be employed, for example, (1) metal particles comprising any of elements such as magnesium, calcium, titanium, zirconium, iron, vanadium, molybdenum, tungsten, zinc, aluminum, silicon, and tin, or (2) particles comprising any of oxides of the above-mentioned elements. Preferable materials for the core material are, for example, iron powder, ferrite-based metal powder, magnetite powder, and glass beads.

The two-component developer of the present invention comprises the above-mentioned carrier and a conventionally known magnetic toner or a conventionally known non-magnetic toner.

In the present invention, there is no particular restriction on the particle diameter of the core material for each carrier particle. It is generally known that there is a tendency that the smaller the particle diameter of the core material, the less magnetized each carrier particle, and accordingly the more easily the deposition of the carrier takes place, because the smaller the particle diameter of each carrier particle, the more easily the carrier can get out of the magnetic control by the developer bearing member.

The carrier of the present invention, however, does not exhibit such a tendency as mentioned above and the deposition of the carrier hardly takes place. It is considered that the reason for this is that the core material is coated with the above-mentioned particular coating material.

In the present invention, there is no restriction on the method for coating the coating material on the core material. For example, there can be employed a dip coating method, a spray coating method, and a fluid spray coating method using a flow coater.

After the coating material is coated on the surface of the core material to form a coating film thereon, the coating film is cured and dried. The curing and drying can be speedily completed by heating the coating film, or by heating and moistening the coating film. It is preferable that the coating film have a thickness of about 2 μm or less, more preferably in the range of 0.1 μm to 1 μm.

The carrier of the present intention can be used by being mixed with toner as a two-component developer for use in electrophotography. The amount of the toner in the two-component developer is usually in the range of about 3 to 7 wt. % of the two-component developer.

There is no particular restriction on an electrophotographic image formation method and an alectrophotographic image formation apparatus, in which the above-mentioned two-component developer is used, provided that the gap between the latent image bearing member and the developer bearing member in the respective facing surfaces thereof is set in a range of 0.1 mm to 0.5 mm. The two-component developer of the present invention is usually contained in a bottle, a cartridge, or in any other conventionally employed containers, and is placed on the market, so that the users thereof can incorporate such a container holding the two-component developer therein in any image formation apparatus and use the two-component developer.

An electrophotographic image formation method of the present invention will now be explained with reference to the following examples:

Other features of this invention will become apparent in the course of the following description of the exemplary embodiments, which are given for illustration of the invention and are not intended to be limiting thereof.

[Preparation of Carrier A]

Formulation of Carrier A

| | Parts by Weight |
|---|---|
| Core material: | |
| Magnetite core material (Trademark "SM-400", made by Dowa Teppun Co., Ltd.) | 5,000 |
| Coating liquid: | |
| Dimethyl silicone resin S | 240 |
| Ethyl silicate 40 (made by Colcoat Co., Ltd.) with the following formula: | 144 |
| 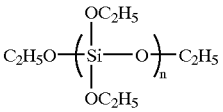 wherein n = 5 (average) | |
| Tin catalyst T (10% toluene solution) $(C_3H_7)_2Sn(OCOCH_3)_2$ | 16.8 |
| γ-aminopropyl-triethoysilane (Tradmark "KBE903", made by Shin-Etsu Chemical Co., Ltd.) | 6 |

The above core material was placed in a fluidized bed provided with a rotary bottom disk. The rotary bottom disk was rotated at 150 rpm, whereby a revolution flow of the core material was formed in the fluidized bed. When the revolution flow of the core material was stabilized, the coating liquid with the above formulation was sprayed on the core material in the revolution flow within the fluidized bed, whereby carrier particles coated with the coating liquid were obtained.

The thus obtained coated carrier particles were heated to 300° C. in an electric furnace for 2 hours, whereby carrier A was obtained.

The thus obtained carrier A had a specific resistivity of $3.98\times10^{15}$ Ω·cm and a fluidity of 34.0 sec/50 g.

The polysiloxane resin coated on the core material in carrier A had an O/Si atomic ratio of 2.78, and a N/Si; atomic ratio of 0.05.

The physical properties of the magnetite core material (Trademark "SM-400", made by Dowa Teppun Co., Ltd.) were investigated with the following results:

(1) Average particle diameter: 44 μm (2) Micro Track particle size distribution;

Particles with a particle size of less than 44 μm were contained in an amount of 40% or more in the magnetite core material. The Micro Track particle size distribution was measured by use of Micro Track (Trademark "Type 7995" made by LEEDS & NORTHRUP Co., Ltd.)

(3) Fluidity: 32.2 sec/50 g

[Preparation of Carrier B]

Formulation of Carrier B

| | Parts by Weight |
|---|---|
| Core material: | |
| Magnetite core material (Trademark "SM-400", made by Dowa Teppun Co., Ltd.) | 5,000 |
| Coating liquid: | |
| Dimethyl silicone resin S | 120 |
| Ethyl silicate 40 (made by Colcoat Co., Ltd.) | 192 |
| Tin catalyst T (10% toluene solution) $(C_3H_7)_2Sn(OCOCH_3)_2$ | 16.8 |
| γ-aminopropyl-triethoxysilane (Tradmark "KBE903", made by Shin-Etsu Chemical Co., Ltd.) | 6 |
| | 6 |

The same procedure as that of producing the carrier A was repeated except that the formulation of the carrier A was changed to the above formulation, whereby carrier B was obtained.

The thus obtained carrier B had a specific resistivity of $6.31\times10^{12}$ Ω·cm and a fluidity of 32.4 sec/50 g.

The polysiloxane resin coated on the core material in carrier B had an O/Si atomic ratio of 3.15, and a N/Si atomic ratio of 0.04.

[Preparation of Carrier C]

Formulation of Carrier C

| | Parts by Weight |
|---|---|
| Core materiai: | |
| Magnetite core material (Trademark "SM-400", made by Dowa Teppun CO., Ltd.) | 5,000 |
| Coating liquid: | |
| Dimethyl silicone resin S | 120 |
| Ethyll silicate 40 (made by Colcoat Co., Ltd.) | 192 |
| Tin catalyst T (10% toluene solution) $(C_3H_7)_2Sn(OCOCH_3)_2$ | 16.8 |
| γ-(2-aminoethyl)aminopropyl-triethoxysilane | 6.0 |

The same procedure as that of producing the carrier A was repeated except that the formulation of the carrier A was changed to the above formulation, whereby carrier C was obtained.

The thus obtained carrier C had a specific resistivity of $5.01\times10^{12}$ Ω·cm and a fluidity of 32.9 sec/50 g.

The polysiloxane resin coated on the core material in carrier C had an O/Si atomic ratio of 3.17, and a N/Si atomic ratio of 0.67.

[Preparation of Carrier D]

Preparation of Coating Liquid "a"

Coating Liquid "a" was prepared by sufficiently dispersing the following components with the following formulation in a homomixer:

| | Parts by Weight |
|---|---|
| Dimethyl silicone resin S with the following formula: | 600 |

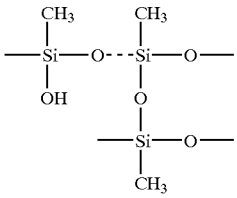

| | |
|---|---|
| (a solution with a 20% solid component in toluene) | |
| Toluene | 600 |
| γ-aminopropyl-triethoxysilane (Tradmark "KBE903", made by Shin-Etsu Chemical Co., Ltd.) | 9.7 |
| Carbon black (Trademark "BP-2000" made by Cabot Corp.) | 10.2 |

Formulation of Carrier D

Formulation of Carrier D

| | Parts by Weight |
|---|---|
| Core material: | |
| Magnetite core material (Trademark "SM-400", made by Dowa Teppun Co., Ltd.) | 5,000 |
| Coating liquid: | |
| Coating Liquid "a" | 1,220 |
| Tin catayst T (10% toluene solution) $(C_3H_7)_2Sn(OCOCH_3)_2$ | 16.8 |

The same procedure as that of producing the carrier A was repeated except that the formulation of the carrier A was changed to the above formulation, whereby carrier D was obtained.

The thus obtained carrier D had a specific resistivity of $2.00\times10^{13}$ Ω·cm, and a fluidity of 38.6 sec/50 g.

The polysiloxane resin coated on the core material in carrier D had an O/Si atomic ratio of 1.66, and a N/Si atomic ratio of 0.09.

[Preparation of Carrier E]

Formulation of Carrier E

Formulation of Carrier E

| | Parts by Weight |
|---|---|
| Core material: | |
| Magnetite core material (Trademark "SM-400", made by Dowa Teppun Co., Ltd.) | 5,000 |
| Coating liquid: | |
| Dimethyl silicone resin S | 360 |
| Ethyl silicate 40 (made by Colcoat Co., Ltd.) | 96 |
| Tin catalyst T (10% toluene solution) $(C_3H_7)_2Sn(OCOCH_3)_2$ | 16.8 |
| γ-aminoropyl-triethoxysilane (Tradmark "KBE903", made by Shin-Etsu Chemical Co., Ltd.) | 9.7 |

The same procedure as that of producing the carrier A was repeated except that the formulation of the carrier A was changed to the above formulation, whereby carrier E was obtained.

The thus obtained carrier E had a specific resistivity of $2.00\times10^{16}$ Ω·n and a fluidity of 35.7 sec/50 g.

The polysiloxane resin coated on the core material in carrier E had an O/Si atomic ratio of 2.40, and a N/Si atomic ratio of 0.06.

[Preparation of Carrier F]

Formulation of Carrier E

| | Parts by Weight |
|---|---|
| Core material: | |
| Magnetite core material (Trademark "SLM-400", made by Dowa Teppun Co., Ltd.) | 5,000 |
| Coating liquid: | |
| Ethyl silicate 40 (made by Colocoat Co., Ltd.) | 240 |
| Tin catalyst T (10% tolene solution) $(C_3H_2)_2Sn(OCOC_3)_2$ | 16.8<br>i.8 |
| γ-aminopropyl-triethoxysilane (Tradmark "KB903", made by Shin-Etsu Chemical Co., Ltd.) | 6.0 |

The same procedure as that of producing the carrier A was repeated except that the formulation of the carrier A was changed to the above formulation, whereby carrier E was obtained.

The thus obtained carrier F had a specific resistivity of $3.16\times108^{8}$ Ω·m and a fluidity of 28.9 sec/50 g.

The polysiloxane resin coated on the core material in carrier F had an O/Si atomic ratio of 3.52, and a N/Si atomic ratio of 0.05.

[Preparation of Toner]

A mixture of the following components with the following formulation was sufficiently stirred and mixed in a Henschel mixer:

| | Parts by Weight |
|---|---|
| Polyester resin A (acid value: 27.1 mgKOH/g, softening point: 147.2° C., glass transition point: 0.4° C., THF-insoluble components: 27.1%) | 60 |
| Polyester resin B (acid value: 9.5 mgKOH/g, softening point: 100.2° C., glass transition point: 2.4° C., THF-insoluble components: 0%) | 40 |
| Camauba wax (melting point: 82° C., acid value: 2) | 3 |
| Carbon black (Trademark "#44" made by Mitsubishi Chemical Corporation) | 8 |
| Chromium-containing monoazo complex | 3 |

The above mixture was kneaded in a roll mill and fused with the application of heat thereto at 130° C. to 140° C. for about 30 minutes, and was then cooled to room temperature. The kneaded mixture was then pulverized in a jet mill, and classified, whereby an intermediate toner was obtained.

The thus obtained intermediate toner had a number-average molecular weight (Mn) of 2,600, and included therein a portion with a molecular weight of 1,000 or less in an amount of 43% in terms of the number of particles in the intermediate toner.

0.5 parts by weight of an additive (Trademark "R972", made by Nippon Aerosil Co., Ltd.) were added to 100 parts by weight of the above intermediate toner. The mixture was then stirred and mixed in a Henschel mixer, and was caused to pass through a sieve to separate therefrom large particles, whereby a toner for use in the present invention was finally obtained.

The thus obtained toner had a weight-average particle diameter of 5.7 μm, and a 4.4 μm average particle diameter extending in length.

The above-mentioned particle diameters of the toner were measured as follows by use of Coulter Counter Model TA II, made by Coulter Electronics Limited:

To 100 ml to 150 ml of an aqueous electrolysis solution, 0.1 ml to 5 ml of a surfactant (preferably an alkylbenzenesulfonate) serving as a dispersant was added. As the electrolysis solution, there can be employed an about 1% aqueous solution of NaCl, prepared by using a first grade NaCl, for example, ISOTON-II (made by Coulter Electronics Limited).

2 to 20 mg of a sample toner to be measured was suspended in the aqueous electrolysis solution. The aqueous electrolysis solution in which the sample toner was suspended was subjected to dispersion treatment in an ultrasonic dispersion mixer for about 1 to 3 minutes.

By use of the above-mentioned measuring instrument, Coulter Counter Model TA II, the particle diameter, the volume and the number of particles of the sample toner were measured, using a 100 μm aperture. The distribution of the volumes of toner particles, which may be referred to as the particle volume distribution, and the distribution of the numbers of toner particles, which may be referred to as the particle number distribution, were calculated from the particle diameter, the volume and the number of particles of the sample toner measured. From the calculated distributions, the weight-average particle diameter (D4) and the average particle diameter (D1) extending in length thereof were determined determined.

In the above-mentioned measuring instrument, segments for measuring the particle diameter ranges are predetermined, which are referred to as channels. The user can choose the channels as desired. In accordance with the user's choice of the channels, all the values to be determined can be automatically obtained by the measuring instrument.

In the above-mentioned measurement of the particle diameter and others, the following 13 channels were chosen in order to perform the measurement of the particle diameter in the range of 2.00 μm to less than 40.30 μm:

2.00 μm to less than 2.52 μm,
2.52 μm to less than 3.17 μm,
3.17 μm to less than 4.00 μm,
4.00 μm to less than 5.04 μm,
5.04 μm to less than 6.35 μm,
6.35 μm to less than 8.00 μm,
8.00 μm to less than 10.08 μm,
10.08 μm to less than 12.70 μm,
12.70 μm to less than 16.00 μm,
15.00 μm to less than 20.20 μm,
20.20 μm to less than 25.40 μm,
25.40 μm to less than 32.00 μm, and
32.00 μm to less than 40.30 μm.

The results of the measurement are shown in the following TABLE 1:

TABLE 1

| Channel No. i | Range of particle diameter | | Representative particle diameter (Di) | Number of particles counted in each channel (ni) | Particle number distribution (ni/N × 100) | Particle volume distribution [$Di^3 \times ni/\Sigma(Di^3 \times ni)$] |
|---|---|---|---|---|---|---|
| 1 | 1.26 | 1.59 | 1.41 | 0 | 0.00 | 0.00 |
| 2 | 1.59 | 2.00 | 1.78 | 0 | 0.00 | 0.00 |
| 3 | 2.00 | 2.52 | 2.24 | 2045 | 6.82 | 0.68 |
| 4 | 2.52 | 3.17 | 2.03 | 3390 | 11.30 | 2.26 |
| 5 | 3.17 | 4.00 | 3.56 | 6913 | 23.04 | 9.23 |
| 6 | 4.00 | 5.04 | 4.49 | 8704 | 29.01 | 23.25 |
| 7 | 5.04 | 6.35 | 5.66 | 6509 | 21.70 | 34.77 |
| 8 | 6.35 | 8.00 | 7.13 | 2135 | 7.12 | 22.81 |
| 9 | 8.00 | 10.10 | 8.98 | 285 | 0.95 | 6.09 |
| 10 | 10.10 | 12.70 | 11.31 | 17 | 0.06 | 0.73 |
| 11 | 12.70 | 16.00 | 14.25 | 2 | 0.01 | 0.17 |
| 12 | 16.00 | 20.20 | 17.96 | 0 | 0.00 | 0.00 |

TABLE 1-continued

| Channel No. i | Range of particle diameter | | Representative particle diameter (Di) | Number of particles counted in each channel (ni) | Particle number distribution (ni/N × 100) | Particle volume distribution [$Di^3 \times ni/\Sigma(Di^3 \times ni)$] |
|---|---|---|---|---|---|---|
| 13 | 20.20 | 25.40 | 22.63 | 0 | 0.00 | 0.00 |
| 14 | 25.40 | 32.00 | 26.51 | 0 | 0.00 | 0.00 |
| 15 | 32.00 | 40.30 | 35.92 | | 0.00 | 0.00 |
| 16 | 40.30 | 50.80 | 45.25 | | 0.00 | 0.00 |
| Σ | | | | N: 30000 | | |

i: Channel No.
Di: Representative particle diameter in each channel
ni: Number of particles counted in each channel
N: Total number of particles counted
Di: Average particle diameter (d1) extending in length
D4: Weight-average particle diameter
$D1 = \Sigma(Di \times ni)/N = 4.4\ \mu m$
$D4 = \Sigma(Di^4 \times ni)/\Sigma(Di^3 \times ni) = 5.7\ \mu m$ Experiment No. 1

Experiment No. 1, including a set of experiments, Examples 1 to 3 and Comparative Examples 1 and 2, was conducted as follows:

EXAMPLE 1

4.0 parts by weight of the above prepared toner and 96.0 parts by weight of carrier A were mixed and stirred in a commercially available mixer with a trademark of "Turbler T2C type", whereby a two-component developer No. 1 was prepared.

500 g of the two-component developer No. 1 was incorporated in a development unit of a modified commercially available copying machine (Trademark "IMAGIO MF4570", made by Ricoh Company, Ltd.), and image formation was conducted under the following image formation conditions:

(1) The gap between the mutually facing surfaces of the latent image bearing member and the developer bearing member, which is hereinafter referred to as the PG, was set at 0.5 mm.

(2) The charging potential was set at −950 V; the development bias, at −600 V; and the potential at the exposure portion, at −150 V.

Images obtained by this image formation under the above-mentioned conditions were evaluated with respect to the number of carrier particles deposited and the image density thereof. The results are shown in TABLE 2.

EXAMPLE 2

Images were formed under the same conditions as in Example 1 except that the PG was narrowed to 0.4 mm, and were subjected to the same evaluation test as in Example 1. The results are shown in TABLE 2.

EXAMPLE 3

Images were formed under the same conditions as in Example 1 except that the PG was narrowed to 0.3 mm, and were subjected to the same evaluation test as in Example 1. The results are shown in TABLE 2.

Comparative Example 1

Images were formned under the same conditions as in Example 1 except that the PG was narrowed to 0.7 mm, and were subjected to the same evaluation test as in Example 1. The results are shown in TABLE 2.

Comparative Example 2

Images were formed under the same conditions as in Example 1 except that the PG was widened to 0.6 mm, and were subjected to the same evaluation test as in Example 1. The results are shown in TABLE 2.

TABLE 2

| Experiment No. 1 | |
|---|---|
| O/Si | 2.78 |
| N/Si | 0.05 |
| Specific resistivity of carrier A (logarithmic value) | 15.6 |

| | PG | Deposition of carrier particles | Image density |
|---|---|---|---|
| Comp. Ex. 1 | 0.7 mm | 1 | 1.01 |
| Comp. Ex. 2 | 0.6 mm | 2 | 1.15 |
| Ex. 1 | 0.5 mm | 2 | 1.37 |
| Ex. 2 | 0.4 mm | 2 | 1.46 |
| Ex. 3 | 0.3 mm | 4 | 1.48 |

The results of Experiment No. 1 shown TABLE 2 indicate that as the PG was narrowed, the number of deposited carrier particles was increased, but the maximum number thereof was only 4, which did not bring about any practical problem. Furthermore, it was confirmed by the results of Experiment No. 1 that images with sufficiently high image density can be obtained even when the PG is 0.5 mm or less as in Examples 1, 2 and 3.

Experiment No. 2

Experiment No. 2, including a set of experiments, Examples 4 to 6 and Comparative Examples 3 and 4, was conducted as follows:

EXAMPLE 4

Images were formed under the same conditions as in Example 1, with the PG set at 0.5 mm, except that carrier A employed in Example 1 was replaced by carrier B, and were subjected to the same evaluation test as in Example 1. The results are shown in TABLE 3.

EXAMPLE 5

Images were formed under the same conditions as in Example 1 except that carrier A employed in Example 1 was replaced by carrier B, and that the PG was narrowed to 0.4 mm, and were subjected to the same evaluation test as in Example 1. The results are shown in TABLE 3.

EXAMPLE 6

Images were formed under the same conditions as in Example 1 except that carrier A employed in Example 1 was replaced by carrier B, and that the PG was narrowed to 0.3 mm, and were subjected to the same evaluation test as in Example 1. The results are shown in TABLE 3.

Comparative Example 3

Images were formed under the same conditions as in Example l except that carrier A employed in Example 1 was replaced by carrier B, and that the PG was widened to 0.7 mm, and were subjected to the same evaluation test as in Example 1. The results are shown in TABLE 3.

Comparative Example 4

Images were formed under the same conditions as in Example 1 except that carrier A employed in Example 1 was replaced by carrier B, and that the PG was widened to 0.6 mm, and were subjected to the same evaluation test as in Example 1. The results are shown in TABLE 3.

TABLE 3

| Experiment No. 2 | | | |
|---|---|---|---|
| O/Si | | 3.15 | |
| N/Si | | 0.04 | |
| Specific resistivity of carrier B (logarithmic value) | | 12.8 | |
| | PG | Deposition of carrier particles | Image density |
| Comp. Ex. 3 | 0.7 mm | 2 | 1.04 |
| Comp. Ex. 4 | 0.6 mm | 2 | 1.22 |
| Ex. 4 | 0.5 mm | 2 | 1.43 |
| Ex. 5 | 0.4 mm | 3 | 1.51 |
| Ex. 6 | 0.3 mm | 4 | 1.53 |

Experiment No. 3

Experiment. No. 3,including a set of experiments, Examples 7 to 9 and Comparative Examples 5 and 6, was conducted as follows:

Images were formed under the same conditions as in Example 1, with the PG set at 0.5 mm, except that carrier A employed in Example 1 was replaced by carrier C, and were subjected to the same evaluation test as in Example 1. The results are shown in TABLE 4.

EXAMPLE 8

Images were formed under the same conditions as in Example 1 except that carrier A employed in Example 1 was replaced by carrier C, and that the FG was narrowed to 0.4 mm, and were subjected to the same evaluation test as in Example 1. The results are shown in TABLE 4.

EXAMPLE 9

Images were formed under the same conditions as in Example 1 except that carrier A employed in Example 1 was replaced by carrier C, and that the PG was narrowed to 0.3 mm, and were subjected to the same evaluation test as in Example 1. The results are shown in TABLE 4.

Comparative Example 5

Images were formed under the same conditions as in Example 1 except that carrier A employed in Example 1 was replaced by carrier C, and that the OG was widened to 0.7 mm, and were subjected to the same evaluation test as in Example 1. The results are shown in TABLE 4.

Comparative Example 6

Images were formed under the same conditions as in Example 1 except that carrier A employed in Example 1 was replaced by carrier C, and that the PG was widened to 0.6 mm, and were subjected to the same evaluation test as in Example 1. The results are shown in TABLE 4.

TABLE 4

| Experiment No. 3 | | | |
|---|---|---|---|
| O/Si | | 3.17 | |
| N/Si | | 0.67 | |
| Specific resistivity of carrier C (logarithmic value) | | 12.7 | |
| | PG | Deposition of carrier particles | Image density |
| Comp. Ex. 5 | 0.7 mm | 1 | 1.09 |
| Comp. Ex. 6 | 0.6 mm | 2 | 1.32 |
| Ex. 7 | 0.5 mm | 2 | 1.47 |
| Ex. 8 | 0.4 mm | 3 | 1.53 |
| Ex. 9 | 0.3 mm | 4 | 1.56 |

Experiment No. 4

Experiment No. 4, including a set of experiments, Comparative Examples 7 to 11, was conducted as follows:

Comparative Example 7

Images were formed under the same conditions as in Example 1 except that carrier A employed in Example 1 was replaced by carrier D, and that that the ?G was widened to 0.7 mm, and were subjected to the same evaluation test as in Example 1. The results are shown in TABLE 5.

Comparative Example 8

Images were formed under the same conditions as in Example 1 except that carrier A employed in Example 1 was replaced by carrier D, and that the PG was widened to 0.6 mm, and were subjected to the same evaluation test as in Example 1. The results are shown in TABLE 5.

Comparative Examples 9

Images were formed under the same conditions as in Example 1 except that carrier A employed in Example 1 was replaced by carrier D, and that the PG was set at 0.5 mm, and were subjected to the same evaluation test as in Example 1. The results are shown in TABLE 5.

Comparative Example 10

Images were formed under the same conditions as in Example 1 except that carrier A employed in Example 1 was replaced by carrier D, and that the PG was narrowed to 0.4 mm and were subjected to the same evaluation test as in Example 1. The results are shown in TABLE 5.

Comparative Example 11

Images were formed under the same conditions as in Example 1 except that carrier A employed in Example 1 was replaced by carrier D, and that the PG was narrowed to 0.3 mm, and were subjected to the same evaluation test as in Example 1. The results are shown in TABLE 5.

TABLE 5

| Experiment No. 4 | | | |
|---|---|---|---|
| O/Si | | 1.66 | |
| N/Si | | 0.09 | |
| Specific resistivity of carrier D (logarithmic value) | | 13.3 | |
| | PG | Deposition of carrier particles | Image density |
| Comp. Ex. 7 | 0.7 mm | 1 | 1.03 |
| Comp. Ex. 8 | 0.6 mm | 3 | 1.19 |
| Comp. Ex. 9 | 0.5 mm | 8 | 1.40 |
| Comp. Ex. 10 | 0.4 mm | 10 | 1.49 |
| Comp. Ex. 11 | 0.3 mm | 15 | 1.51 |

The results of Experiment No. 4 shown in TABLE 5 indicate that as the PG was narrowed to less than 0.5 mm, the number of deposited carrier particles was drastically increased, so that abnormal images with non-transferred portions were frequently formed. Thus, it was impossible to narrow the PG to less than 0.5 mm. Therefore, images with sufficiently high density were not practically obtained in any of the above comparative examples.

Experiment No. 5

Experiment No. 5, including a set of experiments, Comparative Examples 12 to 16, was conducted as follows:

Comparative Examples 12

Images were formed under the same conditions as in Example 1 except that carrier A employed in Example 1 was replaced by carrier E, and that that the PG was widened to 0.7 mm, and were subjected to the same evaluation test as in Example 1. The results are shown in TABLE 6.

Comparative Example 13

Images were formed under the same conditions as in Example I except that carrier A employed in Example I was replaced by carrier E, and that the PG was widened to 0.6 mm, and were subjected to the same evaluation test as in Example 1. The results are shown in TABLE 6.

Comparative Example 14

Images were formed under the same conditions as in Example 1 except that carrier A employed in Example 1 was replaced by carrier E, and that the PG was set at 0.5 mm, and were subjected to the same evaluation test as in Example 1. The results are shown in TABLE 6.

Comparative Example 15

Images were formed under the same conditions as in Example 1 except that carrier A employed in Example 1 was replaced by carrier E, and that the PG was narrowed to 0.4 mm, and were subjected to the same evaluation test as in Example 1. The results are shown in TABLE 6.

Comparative Example 16

Images were formed under the same conditions as in Example 1 except that carrier A employed in Example 1 was replaced by carrier E, and that the PG was narrowed to 0.3 mm, and were subjected to the same evaluation test as in Example 1. The results are shown in TABLE 6.

TABLE 6

| Experiment No. 5 | | | |
|---|---|---|---|
| O/Si | | 2.40 | |
| N/Si | | 0.06 | |
| Specific resistivity of carrier E (logarithmic value) | | 16.3 | |
| | PG | Deposition of carrier particles | Image density |
| Comp. Ex. 12 | 0.7 mm | 0 | 0.86 |
| Comp. Ex. 13 | 0.6 mm | 0 | 0.98 |
| Comp. Ex. 14 | 0.5 mm | 0 | 1.09 |
| Comp. Ex. 15 | 0.4 mm | 1 | 1.23 |
| Comp. Ex. 16 | 0.3 mm | 2 | 1.27 |

The results of Experiment No. 5 shown in TABLE 6 indicate that even though the PG was narrowed, abnormal images with non-transferred portions, caused by the deposition of carrier particles, were scarcely formed. However, images with sufficiently high image density were not obtained even though the PG was narrowed to any extent.

Experiment No. 6

Experiment No. 6, including a set of experiments, Comparative Examples 17 to 21, was conducted as follows:

Comparative Example 17

Images were formed under the same conditions as in Example 1 except that carrier A employed in Example 1 was replaced by carrier A, and that that the PG was widened to 0.7 mm, and were subjected to the same evaluation test as in Example 1. The results are shown in TABLE 7.

Comparative Example 18

Images were formed under the same conditions as in Example 1 except that carrier A employed in Example 1 was replaced by carrier F, and that the PG was widened to 0.6 mm, and were subjected to the same evaluation test as in Example 1. The results are shown in TABLE 7.

Comparative Example 19

Images were formed under the same conditions as in Example 1 except that carrier A employed in Example 1 was replaced by carrier F, and that the PG was set at 0.5 mm, and were subjected to the same evaluation test as in Example 1. The results are shown in TABLE 7.

Comparative Example 20

Images were formed under the same conditions as in Example 1 except that carrier A employed in Example 1 was replaced by carrier F, and that the PG was narrowed to 0.4 mm, and were subjected to the same evaluation test as in Example 1. The results are shown in TABLE 7.

Comparative Example 21

Images were formed under the same conditions as in Example 1 except that carrier A employed in Example 1 was replaced by carrier F, and that the PG was narrowed to 0.3 mm, and were subjected to the same evaluation test as in Example 1. The results are shown in TABLE 7.

TABLE 7

| Experiment No. 6 | | | |
|---|---|---|---|
| O/Si | | 3.52 | |
| N/Si | | 0.05 | |
| Specific resistivity of carrier F (logarithmic value) | | 8.5 | |
| | PG | Deposition of carrier particles | Image density |
| Comp. Ex. 17 | 0.7 mm | 2 | 1.11 |
| Comp. Ex. 18 | 0.6 mm | 4 | 1.34 |
| Comp. Ex. 19 | 0.5 mm | 8 | 1.49 |
| Comp. Ex. 20 | 0.4 mm | 10 | 1.55 |
| Comp. Ex. 21 | 0.3 mm | 16 | 1.56 |

The results of Experiment No. 6 shown in TABLE 7 indicate that as the PG was narrowed to less than 0.5 mm, the number of deposited carrier particles was drastically increased, so that abnormal images with non-transferred portions were frequently formed. Thus, it was impossible to narrow the PG to less than 0.5 mm. Therefore, images with sufficiently high density were not practically obtained in any of the above comparative examples.

Japanese Patent Application No. 11-128879 filed May 10, 1999 is hereby incorporated by reference.

What is claimed is:

1. A carrier for use in electrophotography comprising carrier particles, each carrier particle comprising a core material and a coating material comprising a polysiloxane resin, which is coated on the surface of said core material, said polysiloxane resin comprising at least an oxygen atom (O) and a silicon atom as constituent elements therefor, with an atomic ratio of said constituent elements, O/Si, being in a range of 2.1 to 4.0, said carrier having a specific resistivity of $10^9$ to $10^{16}$ Ω·cm, wherein said polysiloxane resin further comprises a nitrogen atom (N), with an atomic ratio of said nitrogen atom to said silicon atom, N/Si, being in a range of 0.1 to 4.0.

2. The carrier as claimed in claim 1, wherein said carrier has a fluidity of 20 sec/50 g to 40 sec/50 g.

3. A two-component developer for use in electrophotography, comprising a toner and a carrier, said carrier comprising carrier particles, each carrier particle comprising a core material and a coating material comprising a polysiloxane resin, which is coated on the surface of said core material, said polysiloxane resin comprising at least an oxygen atom (O) and a silicon atom as constituent elements therefor, with an atomic ratio of said constituent elements, O/Si, being in a range of 2.1 to 4.0, said carrier having a specific resistivity of $10^9$ to $10^{16}$ Ω·cm, wherein said polysiloxane resin further comprises a nitrogen atom (N), with an atomic ratio of said nitrogen atom to said silicon atom, N/Si, being in a range of 0.1 to 4.0.

4. The two-component developer as in claim 3, wherein said carrier has a fluidity of 20 sec/50 g to 40 sec/50 g.

5. A container holding therein a two-component developer for use in electrophotography, said two-component developer comprising a toner and a carrier, said carrier comprising carrier particles, each carrier particle comprising a core material and a coating material comprising a polysiloxane resin, which is coated on the surface of said core material, said polysiloxane resin comprising at least an oxygen atom (O) and a silicon atom as constituent elements therefor, with an atomic ratio of said constituent elements, O/Si, being in a range of 2.1 to 4.0, said carrier having a specific resistivity of $10^9$ to $10^{16}$ Ω·m, wherein said polysiloxane resin further comprises a nitrogen atom (N), with an atomic ratio of said nitrogen atom to said silicon atom, N/Si, being in a range of 0.1 to 4.0.

6. The container as claimed in claim 5, wherein said carrier for said two-component developer has a fluidity of 20 sec/50 g to 40 sec/50 g.

* * * * *